US011247316B2

(12) United States Patent
Hirabayashi et al.

(10) Patent No.: US 11,247,316 B2
(45) Date of Patent: Feb. 15, 2022

(54) IMPACT TOOL

(71) Applicant: MAKITA CORPORATION, Anjo (JP)

(72) Inventors: Tokuo Hirabayashi, Anjo (JP); Yasuhito Kawai, Anjo (JP)

(73) Assignee: MAKITA CORPORATION, Anjo (JP)

( * ) Notice: Subject to any disclaimer, the term of this patent is extended or adjusted under 35 U.S.C. 154(b) by 561 days.

(21) Appl. No.: 16/169,303

(22) Filed: Oct. 24, 2018

(65) Prior Publication Data

US 2019/0160636 A1 May 30, 2019

(30) Foreign Application Priority Data

Nov. 30, 2017 (JP) ..... JP2017-230792

(51) Int. Cl.

| | |
|---|---|
| ***B65B 21/02*** | (2006.01) |
| ***B25B 21/02*** | (2006.01) |
| ***B25D 16/00*** | (2006.01) |
| ***B25D 11/10*** | (2006.01) |
| *B25B 19/00* | (2006.01) |

(52) U.S. Cl.

CPC ..... *B25B 21/026* (2013.01); *B25D 11/106* (2013.01); *B25D 16/006* (2013.01); *B25B 19/00* (2013.01); *B25D 2216/0023* (2013.01)

(58) Field of Classification Search

CPC ..... B25B 21/026; B25B 19/00; B25B 21/02; B25D 11/106; B25D 16/006; B25D 2216/0023; B25D 2211/06–067

See application file for complete search history.

(56) References Cited

U.S. PATENT DOCUMENTS 5,836,403 A * 11/1998 Putney ..... B25B 21/026 173/205
6,138,772 A * 10/2000 Miescher ..... B25D 16/00 173/109
6,971,455 B2 * 12/2005 Shibata ..... B25D 16/00 173/109

(Continued)

FOREIGN PATENT DOCUMENTS

JP H06-190741 A 7/1994
JP 2012-111035 A 6/2012

(Continued)

OTHER PUBLICATIONS

Apr. 20, 2021 Office Action issued in Japanese Patent Application No. 2017-230792.

*Primary Examiner* — Hemant Desai
*Assistant Examiner* — Mobeen Ahmed
(74) *Attorney, Agent, or Firm* — Oliff PLC

(57) ABSTRACT

An impact tool includes a motor, a first hammer, an anvil, and a second hammer. The first hammer is configured to be rotated by driving of the motor. The anvil is configured to be hammered in a rotation direction by the first hammer. The second hammer is configured to be switchable between a state being linked and a state not being linked to the first hammer. The impact tool ensures selections of a first hammering mode in which only the first hammer hammers the anvil and a second hammering mode in which the first hammer and the second hammer hammer the anvil.

2 Claims, 9 Drawing Sheets

(56) References Cited

U.S. PATENT DOCUMENTS 7,322,427 B2 * 1/2008 Shimma ..... B25D 16/006 173/170
8,981,680 B2 * 3/2015 Suda ..... B25F 5/021 318/3
9,643,300 B2 * 5/2017 Kumagai ..... B25B 21/02
10,583,544 B2 * 3/2020 Herr ..... B25D 11/08
10,786,888 B2 * 9/2020 Chung ..... B25F 5/001
2005/0157489 A1 * 7/2005 Oomori ..... B25F 5/021 362/119
2012/0132452 A1 * 5/2012 Hoop ..... B25B 21/026 173/93.5
2012/0318548 A1 * 12/2012 Hirabayashi ..... B25B 21/00 173/93.6
2012/0322605 A1 * 12/2012 Hirabayashi ..... B25F 5/001 475/149
2013/0032370 A1 * 2/2013 Hirabayashi ..... B25D 11/106 173/47
2013/0033217 A1 * 2/2013 Hirabayashi ..... B25D 11/106 318/546
2013/0076271 A1 * 3/2013 Suda ..... B25F 5/021 318/3
2013/0112449 A1 * 5/2013 Lu ..... B25B 21/026 173/126
2013/0264087 A1 * 10/2013 Harada ..... B23B 45/00 173/213
2015/0000946 A1 * 1/2015 Amend ..... B25B 21/026 173/93
2017/0259411 A1 * 9/2017 Ishibashi ..... B25B 21/026
2018/0222022 A1 * 8/2018 Kumagai ..... B25D 11/104
2019/0283227 A1 * 9/2019 Gumpert ..... B25D 16/006
2021/0086333 A1 * 3/2021 Murakami ..... B25B 21/02

FOREIGN PATENT DOCUMENTS

JP 2012-139801 A 7/2012
JP 2013-035090 A 2/2013
JP 2013-35091 A 2/2013

* cited by examiner

IMPACT TOOL

BACKGROUND

This application claims the benefit of Japanese Patent Application Number 2017-230792 filed on Nov. 30, 2017, the entirety of which is incorporated by reference.

TECHNICAL FIELD

The disclosure relates to an impact tool, such as an impact driver, that includes a mechanism providing a hammering force and an inertia force by rotation to an output shaft, such as an anvil, that projects forward of a housing.

RELATED ART

An impact tool includes an output shaft, such as an anvil, projecting forward of a housing that houses a motor and receiving a rotation from the motor. The impact tool also includes a hammering mechanism in the housing. The hammering mechanism intermittently provides the output shaft with hammering force (impact) in a rotation direction. For example, Japan Patent Application Publication No. 2013-35091 discloses an impact tool with a vibration mechanism including a hammering mechanism that includes a main hammer and a cylindrical-shaped sub hammer. The main hammer is externally mounted on a spindle to which a rotation is transmitted from a motor and engages with an anvil. The spindle is loosely inserted in the sub hammer in a rear of the main hammer. The sub hammer is externally mounted on the main hammer from its rear and is integrally rotatable.

In the above-described impact tool, an impact is generated by engaging/disengaging with/from the anvil with a sum of masses of the main hammer and the sub hammer, and thus, a hammering force and an inertia force in the rotation direction are always constant. However, even in a mechanical hammering mechanism using such a hammer, it is preferred to improve usability by making the hammering force and the inertia force switchable, for example, in a high-low two stages.

Therefore, the object of the disclosure is to provide an impact tool in which a hammering force and an inertia force are easily switchable.

SUMMARY

In order to achieve the above-described object, there is provided an impact tool according to a first aspect of the disclosure. The impact tool includes a motor, a first hammer, an anvil, and a second hammer. The first hammer is configured to be rotated by driving of the motor. The anvil is configured to be hammered in a rotation direction by the first hammer. The second hammer is configured to be switchable between a state being linked and a state not being linked to the first hammer. The impact tool ensures selections of a first hammering mode in which only the first hammer hammers the anvil and a second hammering mode in which the first hammer and the second hammer hammer the anvil.

In the first aspect of the disclosure, the first hammer may include a main hammer and a sub hammer. The main hammer hammers the anvil by moving forward and rearward in an axial direction of the anvil to engage/disengage with/from the anvil. The sub hammer is restricted from moving forward and rearward in the axial direction. The sub hammer is integrally linked to the main hammer in a rotation direction. The second hammer is configured to be switchable between a state being linked and a state not being linked to the sub hammer.

The impact tool may further include linking means configured to integrally link the main hammer and the sub hammer in a front-rear direction. A linkage between the main hammer and the sub hammer by the linking means ensures a selection of a drill mode that restricts a front-rear movement of the main hammer and rotates the main hammer integrally with the anvil.

The impact tool may further include a spindle configured to be rotated by driving of the motor. The main hammer may have a cylindrical shape externally mounted on the spindle. The sub hammer may have a shape of a cylinder having a closed bottom with a front side opening and is externally mounted on the main hammer from a rear. The spindle may be loosely inserted in the sub hammer.

The linking means may be configured by including a ring-shaped fitting groove, a circular hole, and a ball. The fitting groove is formed in a circumferential direction on an outer peripheral surface of the main hammer. The circular hole passes through a peripheral wall of the sub hammer in a radial direction. The ball is fitted across the circular hole and the fitting groove.

The second hammer may be a weight ring externally mounted on the sub hammer and slidable forward and rearward between a rear linkage position and a front non-linkage position. The linkage position is where the second hammer links to the sub hammer to integrally rotate. The non-linkage position is where the linkage to the sub hammer is released. The weight ring in the non-linkage position pushes the ball to an axial center side to fit the ball to the fitting groove.

In order to achieve the object of the disclosure, there is provided an impact tool according to a second aspect of the disclosure. The impact tool includes a motor, a spindle, a hammer, an anvil, an inertia force increasing member, a housing, and a mode switching member. The spindle is configured to be rotated by driving of the motor. The hammer is retained by the spindle. The anvil is hammered in a rotation direction by the hammer. The inertia force increasing member increases inertia force in the hammering by the hammer. The housing houses the motor, the spindle, the hammer, and the anvil. The mode switching member is disposed in the housing. Operating the mode switching member ensures selections of a first position in which the hammer hammers the anvil, a second position in which the hammer whose inertia force is increased by the inertia force increasing member hammers the anvil, and a third position in which the spindle, the hammer, and the anvil integrally rotate.

In this aspect, the inertia force increasing member may be a weight ring externally mounted on the hammer. The inertia force increasing member may be in a non-linkage to the hammer in the first position. The inertia force increasing member may be linked to the hammer in the second position.

The impact tool may ensure switching of a rotational speed of the motor between a plurality of stages.

In order to achieve the object of the disclosure, there is provided an impact tool according to a third aspect of the disclosure. The impact tool includes a motor and a hammer. The hammer is configured to be rotated by driving of the motor. Changing a mass of the hammer ensures changing an inertia force by a rotation of the hammer, and changing a rotational speed of the motor ensures changing the inertia force.

With the disclosure, a hammering force and an inertia force are easily switchable.

DETAILED DESCRIPTION

The following describes embodiments of the disclosure based on the drawings.

Figure 1:
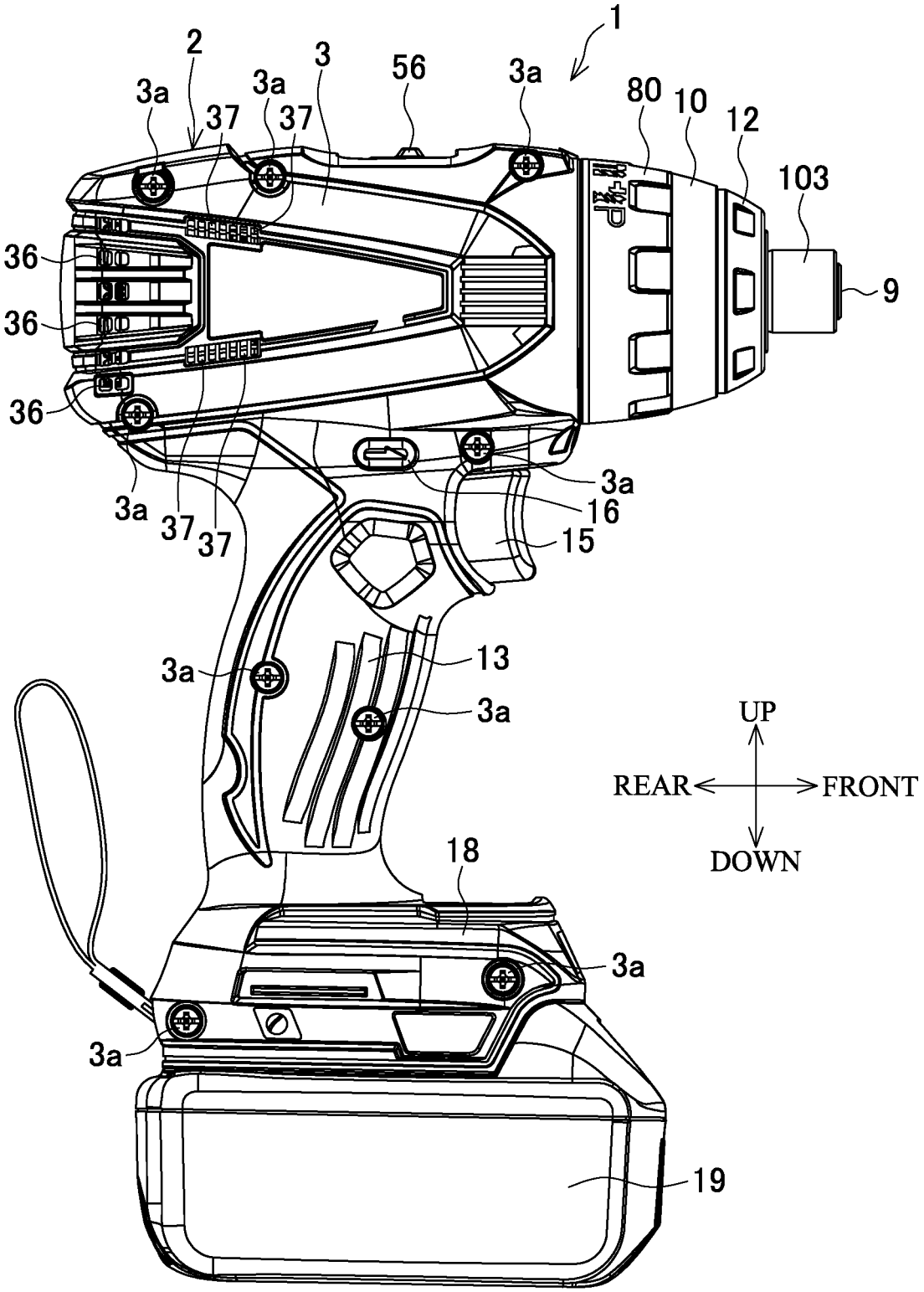
FIG. 1 is a side view of an impact driver.
Figure 2:
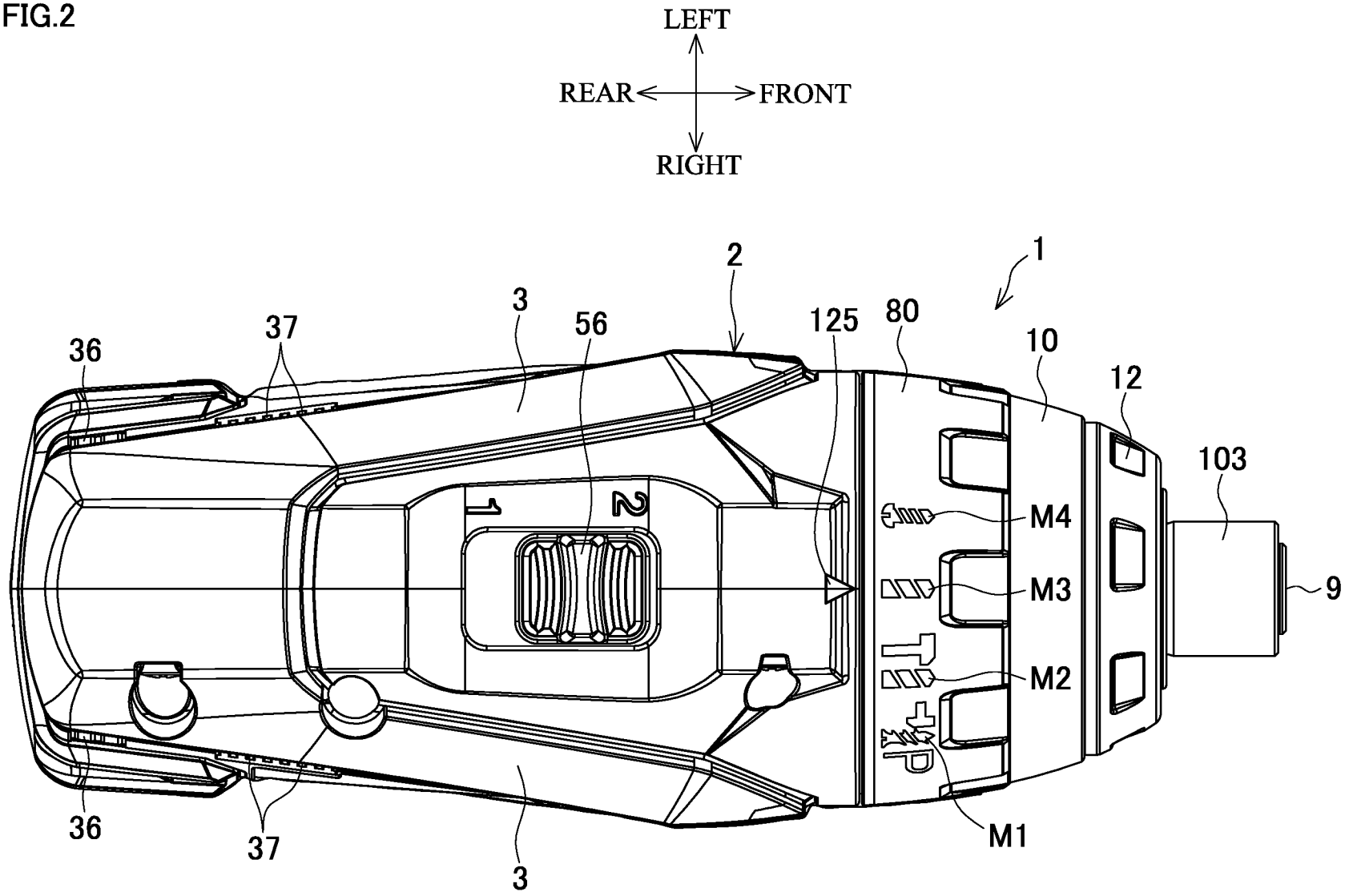
FIG. 2 is a plan view of the impact driver.
Figure 3:
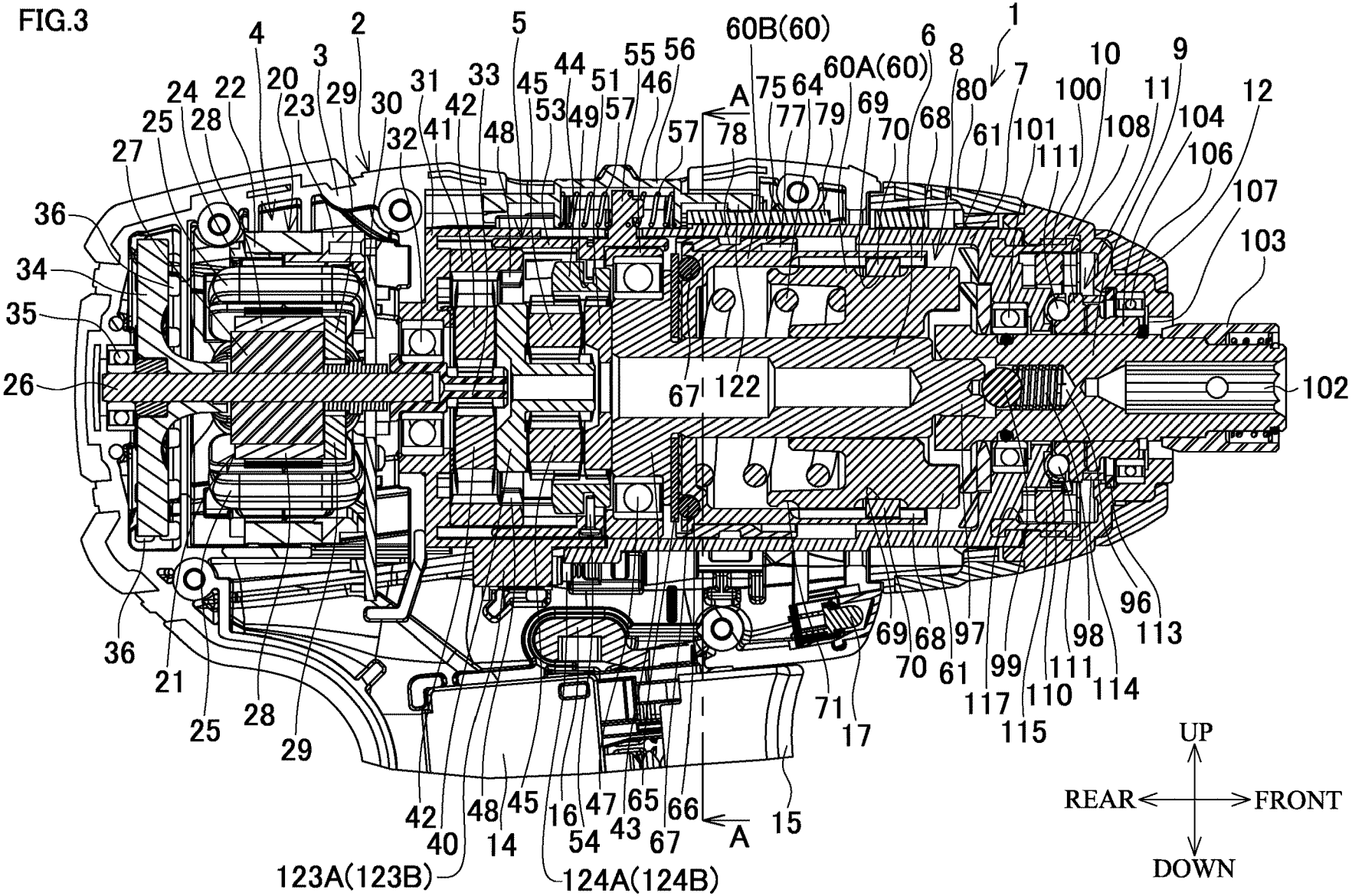
FIG. 3 is a center vertical cross-sectional view of a main body housing portion.

FIG. 1 is a side view of an impact driver 1 as an exemplary impact tool. FIG. 2 is a plan view of the impact driver 1. FIG. 3 is a center vertical cross-sectional view of a main body housing portion.

The impact driver 1 includes a main body housing 2 formed by assembling right and left half housings 3 and 3 with a plurality of screws 3*a*, 3*a*··. In the main body housing 2, a motor 4, a planetary gear reduction mechanism 5, and a spindle 6 are housed from a rear. The main body housing 2 has a front portion in which a cylindrical-shaped inner housing 7 that houses a hammering mechanism 8 together with the spindle 6 is assembled. An anvil 9 as an output shaft is coaxially disposed in a front side of the spindle 6. The anvil 9 is pivotally supported by a front housing 10 secured to the inner housing 7 and a front end of the inner housing 7, and projects forward. The front housing 10 internally houses a vibration mechanism 11. The front housing 10 has a front end on which a ring shaped bumper 12 made of rubber is fitted.

A handlebar 13 is disposed to extend downward in a lower side of the main body housing 2. The handlebar 13 internally houses a switch 14 including a trigger 15. In an upper side of the switch 14, a forward-reverse switching lever 16 of the motor 4 is disposed. An LED 17 that irradiates ahead of the anvil 9 is disposed ahead of the forward-reverse switching lever 16.

The handlebar 13 has a lower end where a battery mounting portion 18 is formed. A battery pack 19 as a power source is slidingly mounted to the battery mounting portion 18 from ahead. The battery mounting portion 18 internally houses a terminal block and a controller (both of which are not illustrated). The terminal block is electrically coupled to the mounted battery pack 19. The controller is made of a control circuit board including a microcomputer that controls the motor 4, a switching element, and similar component.

The motor 4 is an inner rotor type brushless motor made of a stator 20 and a rotor 21 inside the stator 20. The stator 20 includes a cylindrical-shaped stator core 22, a front insulator 23 and a rear insulator 24, and a plurality of coils 25, 25··. The front insulator 23 and the rear insulator 24 are disposed at front and rear end surfaces of the stator core 22. The plurality of coils 25, 25·· are wound inside the stator core 22 via the front and rear insulators 23 and 24. The rotor 21 includes a rotation shaft 26, a cylindrical-shaped rotor core 27, cylindrical-shaped permanent magnets 28, 28··, and a plurality of sensor permanent-magnets 29, 29··. The rotation shaft 26 is positioned at an axial center. The rotor core 27 is disposed around the rotation shaft 26. The permanent magnets 28, 28·· are disposed outside the rotor core 27. The permanent magnets 28, 28·· have polarity alternately changed in a circumferential direction. The plurality of sensor permanent-magnets 29, 29·· are radially disposed ahead of the permanent magnets 28, 28··. The front insulator 23 has a front surface on which a sensor circuit board 30 that include a rotation detecting element detecting positions of the sensor permanent-magnets 29, 29·· is mounted.

The rotation shaft 26 has a front end that passes through a rear end surface of a gear housing 31 in a shape of a cylinder having a closed bottom assembled in a rear portion of the inner housing 7 in the main body housing 2, and then, is pivotally supported by a bearing 32. The front end of the rotation shaft 26 has a pinion 33 mounted.

Meanwhile, the rotation shaft 26 has a rear end on which a centrifugal fan 34 is mounted and a bearing 35 is assembled onto a rear side of the centrifugal fan 34. Radially outside the centrifugal fan 34 and on a side surface of the main body housing 2, a plurality of exhaust outlets 36, 36·· are formed. A plurality of air intake ports 37, 37·· are formed on the side surface of the main body housing 2 ahead of the exhaust outlets 36 and radially outside to a rear side of the sensor circuit board 30.

[Planetary Gear Reduction Mechanism and Transmission Mechanism]

Figure 4:
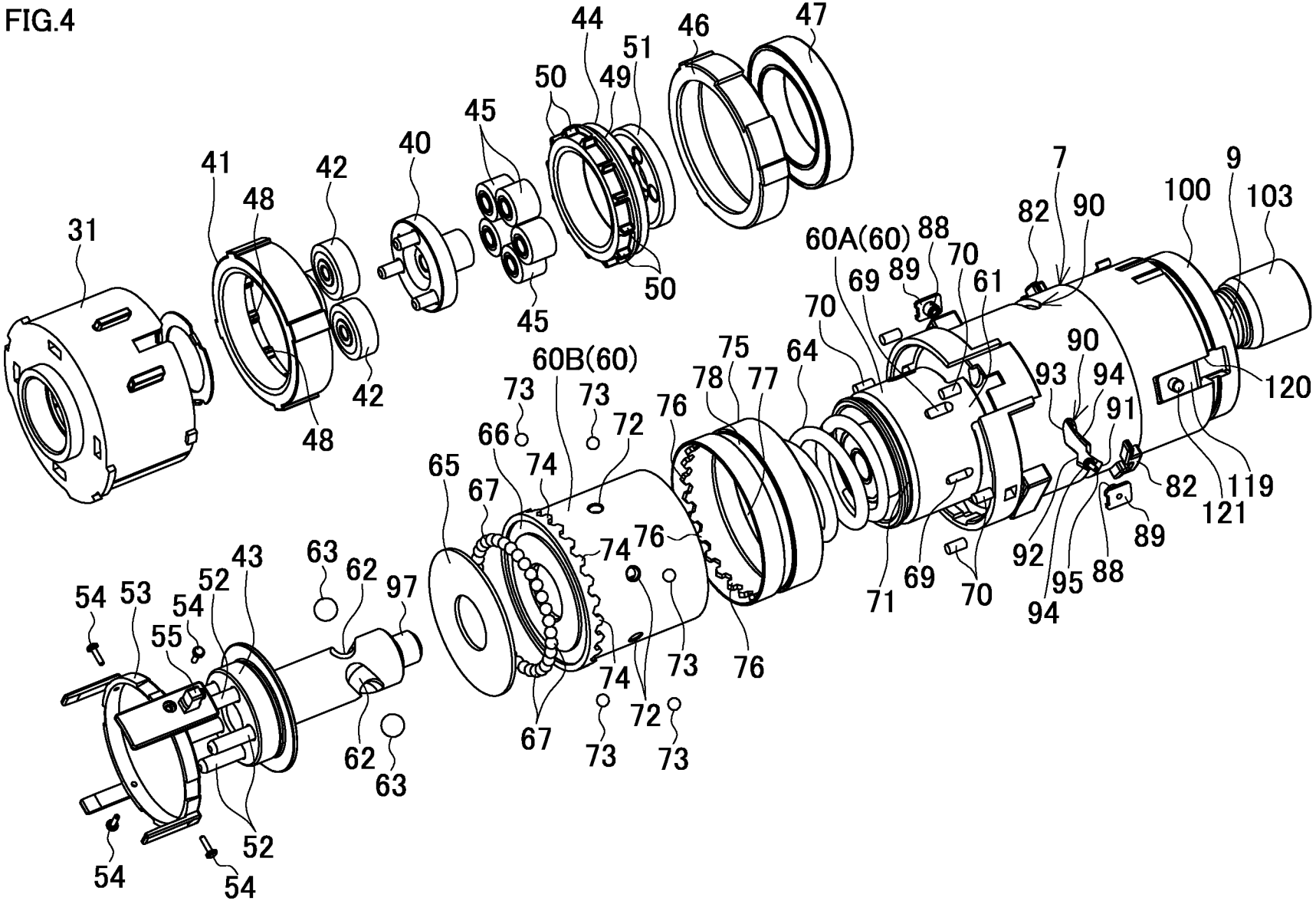
FIG. 4 is an exploded perspective view of a planetary gear reduction mechanism and a hammering mechanism.

The planetary gear reduction mechanism 5 is housed within the gear housing 31 ahead of the motor 4. As illustrated in FIG. 4, the planetary gear reduction mechanism 5 includes a first carrier 40 and a second carrier 43. The first carrier 40 retains planetary gears 42, 42·· in a first stage that make a planetary motion within a first internal gear 41. The second carrier 43 retains planetary gears 45, 45·· in a second stage that make a planetary motion within a second internal gear 44. The planetary gear 42 in the first stage is engaged with the pinion 33 of the rotation shaft 26 projecting into the gear housing 31. The second carrier 43 is formed integrally with a rear end of the spindle 6 and pivotally supported by a bearing 47 retained by a retention ring 46 disposed in the gear housing 31.

Here, the first internal gear 41 has an inner peripheral front side on which a plurality of internal teeth 48, 48·· are disposed at predetermined intervals in a circumferential direction. Meanwhile, the second internal gear 44 has an outer peripheral front side and an outer peripheral rear side on which a ring-shaped engaging groove 49 and a plurality of external teeth 50, 50·· disposed to protrude at predetermined intervals in the circumferential direction are respectively disposed. The second internal gear 44 is disposed to be slidable between an advanced position and a retreated position. The advanced position is a positon where the second internal gear 44 engages with both a spur gear 51, which is coupled integrally to a rear side of the second carrier 43, and the planetary gears 45, 45·· in the second stage. The retreated position is a positon where the second internal gear 44 engages only with the planetary gears 45, 45·· in the second stage by engaging the external teeth 50 with the internal teeth 48 of the first internal gear 41.

The spur gear 51 is passed through by support pins 52, 52·· that support the planetary gears 45, 45··, and is a separate gear positioned between the second carrier 43 and the planetary gears 45, 45··. The second carrier 43 has an outer diameter smaller than an outer diameter of the spur gear 51 including tooth tips.

A slide ring 53 slidable forward and rearward along an inner peripheral surface of the gear housing 31 and the inner housing 7 is disposed outside the second internal gear 44. Engaging pins 54, 54·· passing through in a radial direction from an outside of the slide ring 53 engage with the engaging groove 49 of the second internal gear 44. The slide ring 53 has an upper outer periphery on which a protrusion 55 that protrudes in an upper portion of the gear housing 31 is disposed. The protrusion 55 is retained in a slide button 56 via front and rear coil springs 57 and 57. The slide button 56 is disposed in the main body housing 2 so as to be slidable forward and rearward.

Accordingly, a sliding operation forward and rearward of the slide button 56 forms a transmission mechanism configured to switch a position of the second internal gear 44 forward and rearward via the slide ring 53. That is, in the advanced position of the second internal gear 44, the second internal gear 44 integrally rotates with the spur gear 51 to cancel the planetary motion of the planetary gears 45, 45··, and thus, a high speed mode (second speed) is provided. In the retreated position of the second internal gear 44, a low speed mode (first speed) in which the second internal gear 44 is secured to cause the planetary gears 45, 45·· to make the planetary motion is provided.

[Hammering Mechanism]

The hammering mechanism 8 has a structure that engages/disengages a hammer 60 with/from a pair of arms (not illustrated) disposed at a rear end of the anvil 9. The hammer 60 here is divided into a cylindrical-shaped main hammer 60A and a sub hammer 60B in a shape of a cylinder having a closed bottom with the front side opening. The main hammer 60A is externally mounted on a front end of the spindle 6 and has a front surface on which a pair of stops 61 and 61 that engage with the arms are disposed to protrude. The spindle 6 is loosely inserted in the sub hammer 60B to be coaxial with the spindle 6 in a rear of the main hammer 60A. The sub hammer 60B is externally mounted on the main hammer 60A from the rear. A diameter obtained by combining peripheral walls of the main hammer 60A and the sub hammer 60B is equal to an outer diameter of a conventional hammer.

First, the main hammer 60A is coupled to the spindle 6 via balls 63 and 63 fitted across mountain shaped grooves (not illustrated) and V-shaped grooves 62 and 62. The mountain shaped grooves are disposed to depress from the front end toward the rear side on an inner peripheral surface of the main hammer 60A and have rear ends that taper. The V-shaped grooves 62 and 62 are disposed to depress with distal ends facing the front on an outer peripheral surface of the spindle 6.

Meanwhile, a coil spring 64 is externally mounted on the spindle 6 between the main hammer 60A and the sub hammer 60B. The coil spring 64, while biasing the main hammer 60A to the advanced position where the stops 61 engage with the arms, biases the sub hammer 60B rearward. A washer 65 is externally mounted on the spindle 6 between the sub hammer 60B and the second carrier 43. A ring groove 66 disposed to depress on a rear surface of the sub hammer 60B houses a plurality of balls 67, 67·· that project from the rear surface. Thus, a thrust bearing is formed. Accordingly, the sub hammer 60B biased rearward by the coil spring 64 is restricted from moving forward and rearward by being pushed to the rear position where the balls 67 abut on the washer 65 in a state where the balls 67 are rotatable.

The sub hammer 60B has a peripheral wall whose inner peripheral surface includes a plurality of guide grooves 68, 68·· at regular intervals in a circumferential direction. The plurality of guide grooves 68, 68·· extend rearward in an axial direction from a front end. The main hammer 60A has an outer periphery that includes a plurality of oval grooves 69, 69·· at intervals identical to the guide grooves 68 in the circumferential direction. The plurality of oval grooves 69, 69·· are shorter than the guide grooves 68. Column-shaped coupling pins 70, 70·· are fitted across the guide grooves 68 and the oval grooves 69. Accordingly, the main hammer 60A and the sub hammer 60B are integrally coupled in a rotation direction by the coupling pins 70 in a state where a relative movement in the axial direction is allowed.

Furthermore, a ring-shaped fitting groove 71 is disposed to depress in a circumferential direction at a rear end on the outer peripheral surface of the main hammer 60A. Meanwhile, a plurality of circular holes 72, 72·· that pass through the peripheral wall of the sub hammer 60B in a radial direction is formed between the guide grooves 68 and 68 in a rear end position of the guide groove 68. Respective balls 73 are fitted in the circular holes 72. In addition, on an outer periphery in the rear end of the sub hammer 60B, a plurality of rear protrusions 74, 74·· having a mountain shape toward the front are disposed to protrude at regular intervals in the circumferential direction.

Figure 5:
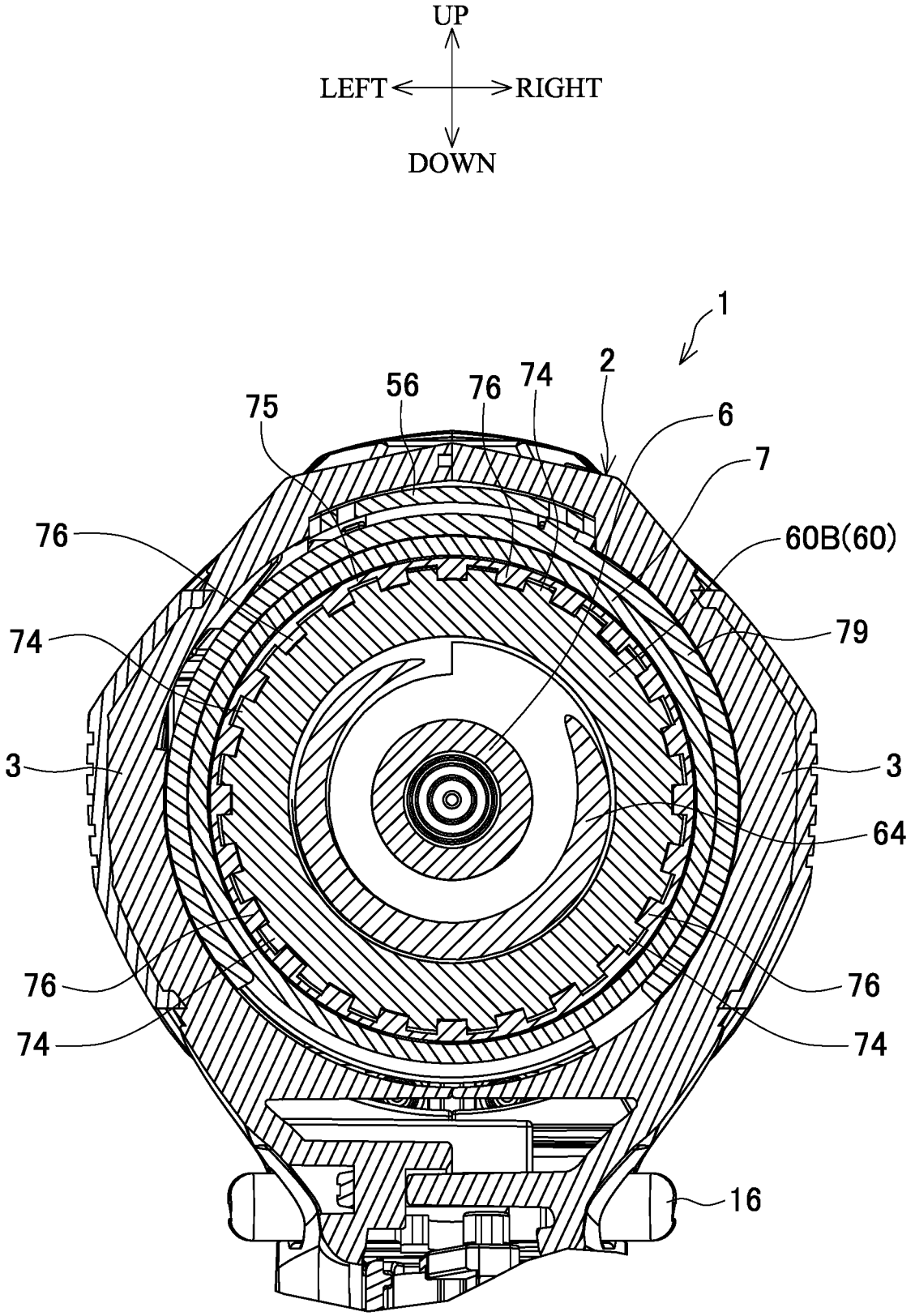
FIG. 5 is a cross-sectional view taken along the line A-A in FIG. 3.

A weight ring 75 is externally mounted on the peripheral wall of the sub hammer 60B. The weight ring 75 has an inner diameter whose inner periphery being slidingly in contact with the peripheral wall of the sub hammer 60B. The weight ring 75 has an inner periphery at a rear end on which a plurality of front protrusions 76, 76·· having a mountain shape toward the rear are disposed to protrude at regular intervals in the circumferential direction. The plurality of front protrusions 76, 76·· mesh with the rear protrusions 74, 74·· of the sub hammer 60B. The inner periphery of the weight ring 75 includes a ring-shaped clearance groove 77 from the front end to the rear. Furthermore, a ring-shaped depressed groove 78 is formed in a middle portion in the front-rear direction on the outer peripheral surface of the weight ring 75. As illustrated in FIG. 5, the weight ring 75 is slidable forward and rearward between a rear linkage position and a front non-linkage position. The linkage position is where the front protrusions 76, 76·· engage with the rear protrusions 74, 74·· of the sub hammer 60B to integrally rotate with the sub hammer 60B. The non-linkage position is where the front protrusions 76, 76·· move away from the rear protrusions 74, 74·· to release the linkage with the sub hammer 60B.

Figure 6:
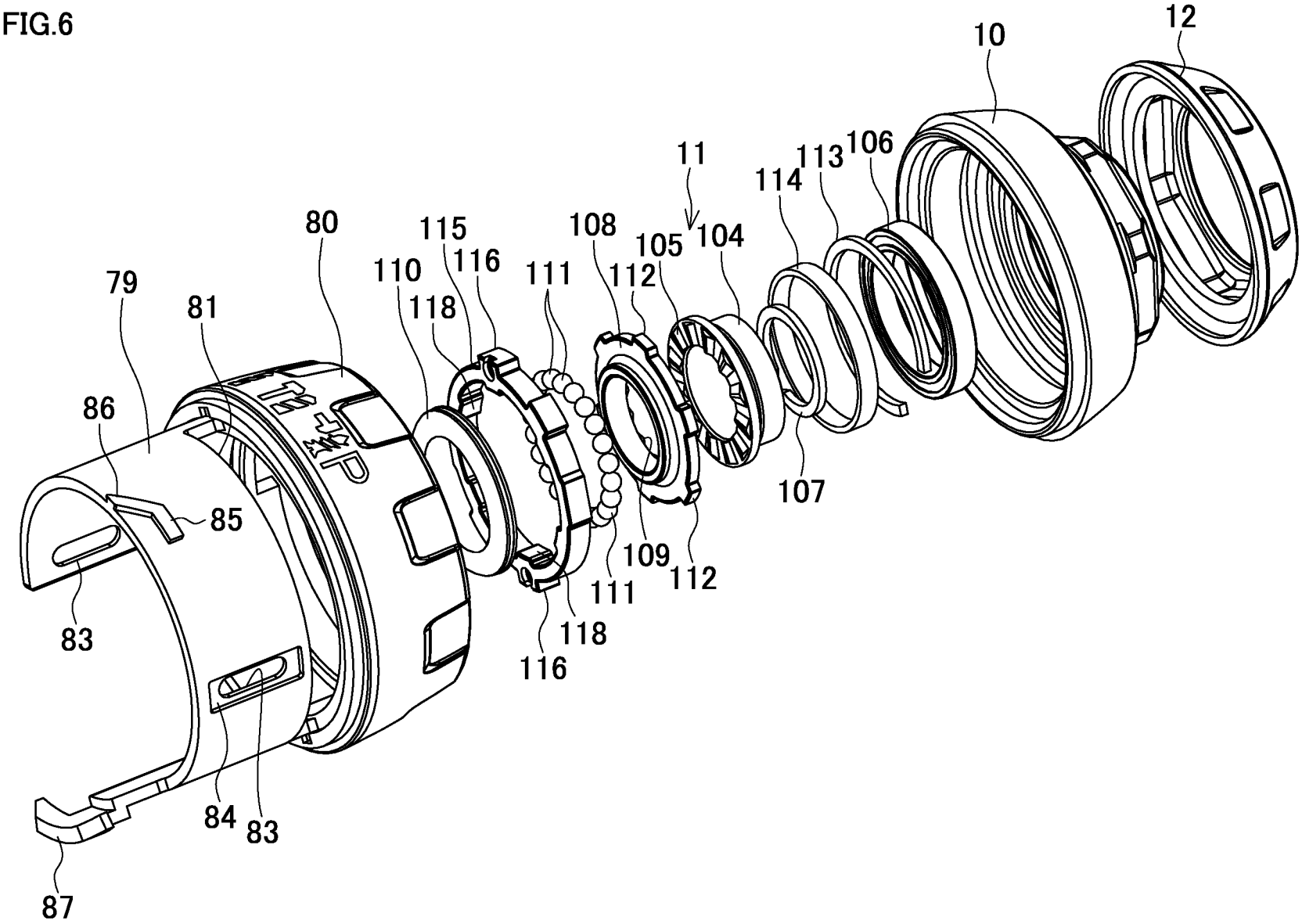
FIG. 6 is an exploded perspective view of a vibration mechanism.

Meanwhile, as illustrated in FIG. 6 as well, a linkage sleeve 79 is externally mounted on the inner housing 7. The linkage sleeve 79 has an outer periphery at a front end on which a mode switching ring 80 as a mode switching member positioned ahead of the main body housing 2 is mounted in an integrally rotatable manner. The linkage sleeve 79 has a cylindrical body in a C-shape that notched a part in the circumferential direction along a whole length in an axial direction. The linkage sleeve 79 has a center portion in the front-rear direction where a cutout 81 in a circumferential direction is formed. In the cutout 81, a guide protrusion 82 disposed to protrude on the outer peripheral surface of the inner housing 7 is fitted, and thus, the linkage sleeve 79 is rotatable in a state where a movement in the front-rear direction is restricted. A pair of through-holes 83 and 83 in an oval shape in the front-rear direction are formed at point symmetric positions in a rear of the cutout 81 and on an outer periphery of the linkage sleeve 79. On outer peripheral surfaces along the respective through-holes 83, quadrangle-shaped guide depressed portions 84 slightly larger than the through-holes 83 are formed. Furthermore, on an outer peripheral surface between the guide depressed portions 84 and 84, a first projection 85 that is along the circumferential direction and a second projection 86 that inclines rearward in a straight line as approaching the circumferential direction from an end portion of the first projection 85 are disposed to protrude. The linkage sleeve 79 has a rear end at a position approximately point symmetrical to both projections 85 and 86 where a contact maker 87 is formed. The contact maker 87 pushes in or releases plungers 124A and 124B of micro switches 123A and 123B described later.

Through the respective through-holes 83 of the linkage sleeve 79, cylindrical-shaped guide holders 88 including square-shaped flange portions 89 fitted to the guide depressed portions 84 at an outer end are passed. The respective guide holders 88 project to an axial center side of the linkage sleeve 79 in a radial direction, and are movable in the front-rear direction by guiding of the flange portions 89 along the guide depressed portions 84.

The inner housing 7 includes guide grooves 90 formed of a front side groove 91, a middle groove 92, a rear side groove 93, and inclined grooves 94 and 94. The guide holder 88 passes through the guide groove 90. The front side groove 91 is formed in the circumferential direction in a front-rear position corresponding to a front end of the through-hole 83. The middle groove 92 is formed in the circumferential direction in a front-rear position corresponding to a middle of the through-hole 83. The rear side groove 93 is formed in the circumferential direction in a front-rear position corresponding to a rear end of the through-hole 83. The respective inclined grooves 94 and 94 communicate between the front side groove 91 and the middle groove 92, and between the middle groove 92 and the rear side groove 93. A guide pin 95 is inserted into the guide holder 88 from the axial center side of the inner housing 7 via the guide groove 90 such that a head of the guide pin 95 is fitted to the depressed groove 78 of the weight ring 75.

The anvil 9 coaxially and pivotally supports a front end of the spindle 6 by fitting a distal end 97 having a small diameter disposed to protrude to the front end of the spindle 6 into a bearing hole 96 formed in an axial center on a rear surface. The bearing hole 96 houses a ball 99 that is pushed onto an end surface of the distal end 97 by a coil spring 98 so as to receive a load in a thrust direction. The anvil 9 is pivotally supported via a bearing 101 inside a front cylinder 100 coaxially linked to the front surface of the inner housing 7 outside the ball 99.

Furthermore, in a front end of the anvil 9 that projects from the front housing 10, a mounting hole 102 for a bit is formed and a chuck mechanism is disposed. The chuck mechanism includes, for example, a sleeve 103 that pushes a ball disposed in the anvil 9 into the mounting hole 102 in a retreated position in order to mount and retain the bit inserted in the mounting hole 102.

[Vibration Mechanism]

The vibration mechanism 11 is housed inside the front cylinder 100 of the inner housing 7 and the front housing 10 externally mounted on the front cylinder 100. First, a first cam 104 on which a cam surface 105 is formed on a rear surface is integrally and fixedly secured to the anvil 9 inside the front housing 10, and is pivotally supported by a bearing 106 inside the front housing 10 as illustrated in FIG. 6. The first cam 104 and the bearing 106 have a front side where a retaining ring 107 is disposed.

A second cam 108 whose front surface has a cam surface 109 is externally mounted to be rotatable on the anvil 9 in the rear of the first cam 104. The second cam 108 has a rear surface retained by a plurality of balls 111, 111·· housed along a ring-shaped bracket 110 on a front surface of the inner housing 7. In an ordinary state, the cam surface 109 engages with the cam surface 105 of the first cam 104. The second cam 108 has an outer periphery on which a plurality of protrusions 112, 112·· projecting in a radial direction are formed at regular intervals in the circumferential direction. Between the outer periphery of the second cam 108 and the bearing 106, a spring washer 113 and a spacer 114 are interposed.

Meanwhile, in the front cylinder 100, a vibration switching ring 115 is disposed. The vibration switching ring 115 is a ring body having an inner diameter larger than an outer diameter of the second cam 108. The vibration switching ring 115 is retained to be movable forward and rearward in a state where a rotation is restricted in the front cylinder 100 by fitting a plurality of outer protrusions 116, 116·· disposed to protrude on an outer periphery to restricting grooves 117, 117·· in the axial direction disposed on an inner surface of the front cylinder 100. The vibration switching ring 115 has an inner periphery on which inner protrusions 118 are disposed to protrude. The inner protrusions 118 lock onto the protrusions 112 of the second cam 108 in a state where the vibration switching ring 115 is externally mounted on the second cam 108. That is, the rotation of the second cam 108 is restricted in an advanced position where the vibration switching ring 115 is externally mounted on the second cam 108, and the rotation of the second cam 108 is allowed in a retreated position where the vibration switching ring 115 separates from the second cam 108.

A pair of linkage plates 119 and 119 (FIG. 4) are locked to the vibration switching ring 115. The linkage plate 119 is a plate-shaped metal plate disposed to be point symmetric in a front side surface of the inner housing 7. Guiding of a pair of outer grooves 120 and 120 formed in the front-rear direction on the side surface of the inner housing 7 causes the linkage plate 119 to be movable in the front-rear direction. The respective linkage plates 119 have outer surfaces on which engagement protrusions 121 that project outward are formed.

The mode switching ring 80 has an inner peripheral surface on which guide grooves (not illustrated) where the engagement protrusions 121 of the respective linkage plates 119 are fitted are formed. In association with a rotating operation of the mode switching ring 80, it is possible to select a first position where the linkage plates 119 and 119 move forward to move the vibration switching ring 115 to the advanced position and a second position where the linkage plates 119 and 119 retreat to move the vibration switching ring 115 to the retreated position.

Meanwhile, in a corner portion on a left side in a front end on a lower surface of the slide button 56, a receiving protrusion 122 (FIG. 3) is disposed to protrude. The receiving protrusion 122 engages with a distal end of the second projection 86 when the linkage sleeve 79 rotates in a state where the slide button 56 is in the retreated position as a first speed. Accordingly, when the linkage sleeve 79 rotates in this state, the receiving protrusion 122 is guided forward along the second projection 86, and thus, the slide button 56 moves forward. When the receiving protrusion 122 rides over a front of the first projection 85, the slide button 56 reaches the advanced position as a second speed.

The right and left pair of micro switches 123A and 123B are disposed with the plungers 124A and 124B facing forward in a rear lower surface of the inner housing 7. These micro switches 123A and 123B output ON/OFF signals of a clutch mode to a controller disposed at a lower end of the handlebar 13. The controller monitors a torque value obtained from a torque sensor (not illustrated) disposed in the motor 4 when an ON signal is input by only the plunger 124B of the micro switch 123B being pushed in. The controller cuts off the torque to the anvil 9 by braking the motor 4 when the set torque value is reached.

[Selection of each Operation Mode]

A description will be given of rotation positions (switching positions) of the mode switching ring 80 and the linkage sleeve 79, and the respective operation modes in the impact driver 1 configured as described above.

(1) Power Impact Mode

Figure 7A:
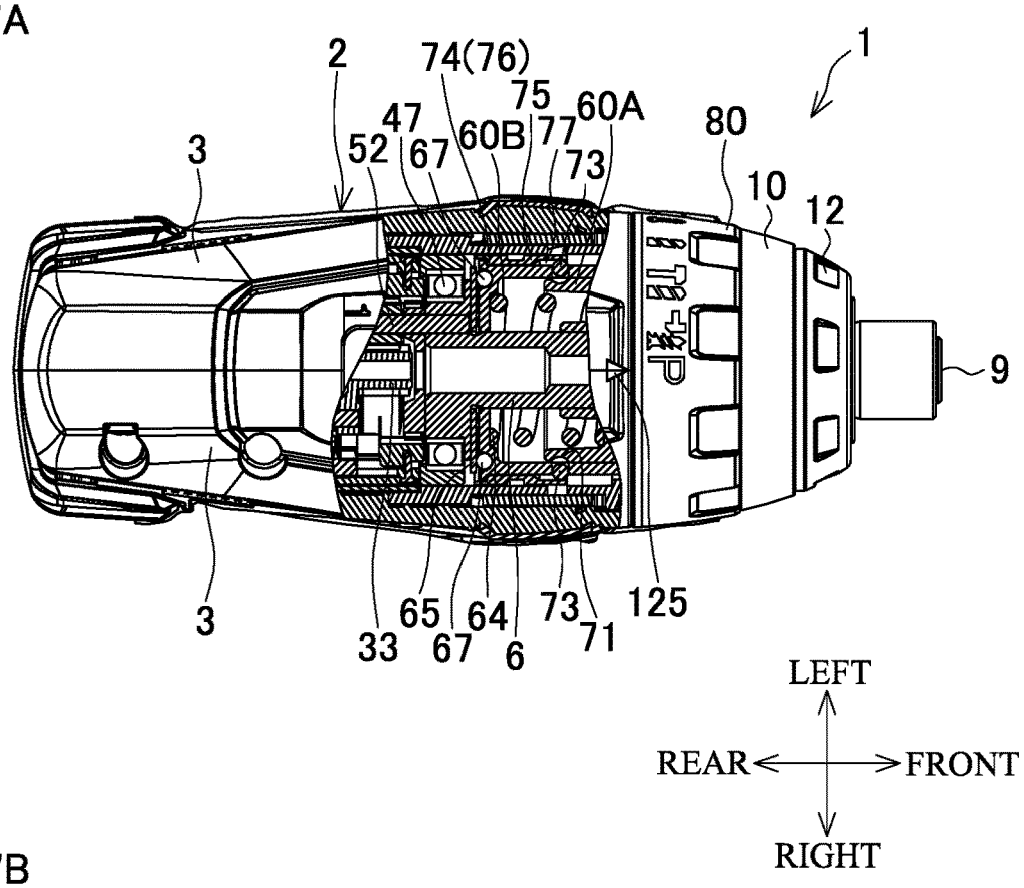
FIG. 7A is a plan view cross-sectionally illustrating a part of a unit portion in a power impact mode.
Figure 7B:
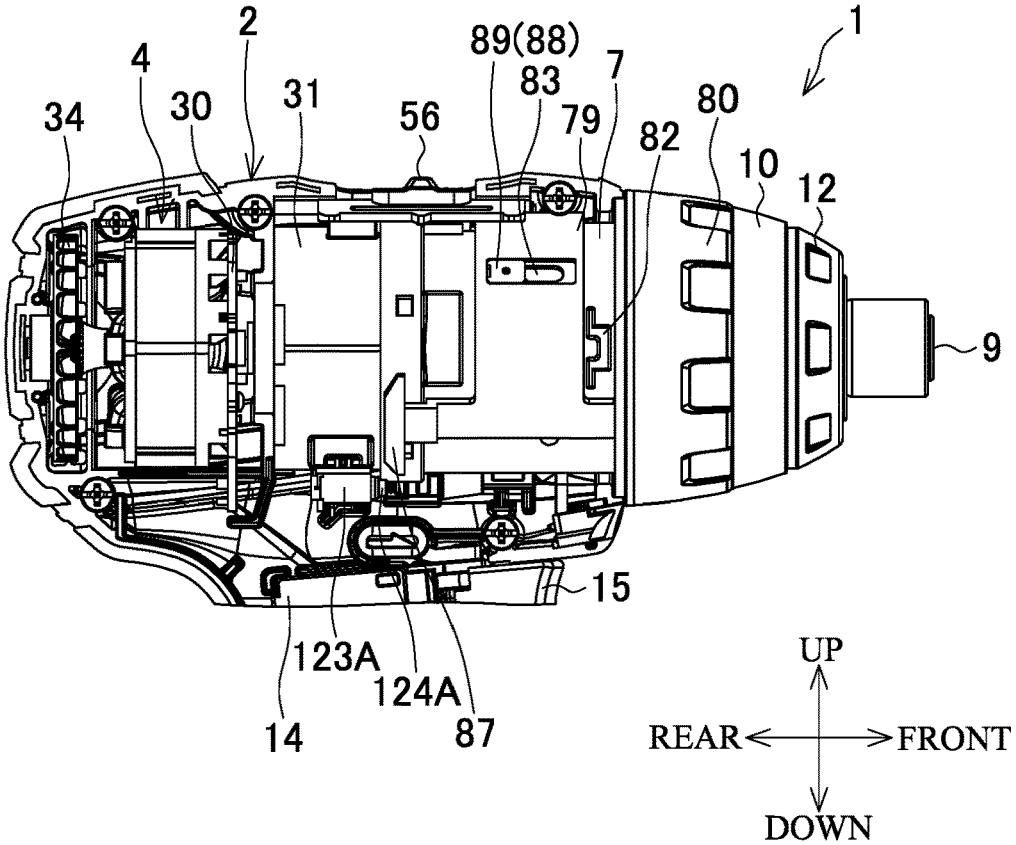
FIG. 7B is a side view omitting a right half housing.

First, as illustrated in FIG. 7A, in a first position (switching position where an indication P of the mode switching ring 80 is positioned ahead of an arrow 125 disposed on a top surface of the main body housing 2) provided by rotating the mode switching ring 80 to the rightmost when viewed from a front, the guide holder 88 integral with the linkage sleeve 79 in the rotation direction also moves in a right rotational direction to move inside the guide groove 90 to reach the rear side groove 93. Accordingly, as illustrated in FIG. 7B, the guide holder 88 is positioned at the rear end of the through-hole 83. Then, the weight ring 75 coupled to the guide holder 88 via the guide pin 95 retreats to the linkage position where the front protrusion 76 engages with the rear protrusion 74 of the sub hammer 60B to position the clearance groove 77 outside the balls 73, 73··. Each of the balls 73 sinks into the inner peripheral surface of the sub hammer 60B in this linkage position and can move to a release position separating from the fitting groove 71 of the main hammer 60A. Accordingly, the retreat of the main hammer 60A is allowed and a power impact mode (second hammering mode, second rotation mode) that integrally rotates the sub hammer 60B with the main hammer 60A as well as the weight ring 75 is provided.

At this time, the first projection 85 of the linkage sleeve 79 is positioned in the rear of the receiving protrusion 122 of the slide button 56, and thus, the slide button 56 is moved to the advanced position. Therefore, the retreat of the slide button 56 is restricted, and a high speed mode is constantly provided. Meanwhile, the linkage plates 119 and 119 are in the retreated position so as to retreat the vibration switching ring 115 and cause the rotation of the second cam 108 to be free. The contact maker 87 is not in contact with any of the plungers 124A and 124B of the micro switches 123A and 123B.

Accordingly, operating the trigger 15 disposed in the handlebar 13 to turn the switch 14 ON drives the motor 4. That is, the controller obtains a rotating state of the rotor 21 based on positions of the sensor permanent-magnets 29 and 29 detected by the rotation detecting element of the sensor circuit board 30, and flows a current to the coils 25 and 25 of the stator 20 in order by ON/OFF operations of the switching element. Thus, the rotor 21 is rotated. Then, the rotation of the rotation shaft 26 of the rotor 21 is transmitted to the spindle 6 via the planetary gear reduction mechanism 5, and then, the spindle 6 is rotated. The spindle 6 rotates the main hammer 60A via the balls 63 and 63 to rotate the anvil 9 with which the main hammer 60A engages. Therefore, the bit mounted on the distal end of the anvil 9 can, for example, tighten a screw. At this time, the sub hammer 60B coupled in the rotation direction via the coupling pin 70, 70·· also rotates integrally with the main hammer 60A as well as the weight ring 75. It should be noted that, even though the first cam 104 rotates in association with the rotation of the anvil 9, the rotation of the second cam 108 that engages with the first cam 104 is free. Therefore, the second cam 108 also integrally rotates, and thus, no vibration is generated in the anvil 9.

As the screw is tighten and the torque of the anvil 9 increases, a difference is generated between the rotation of the main hammer 60A and the rotation of the spindle 6. Therefore, the balls 63 and 63 rolling along the V-shaped grooves 62 and 62 causes the main hammer 60A to retreat against a biasing of the coil spring 64 while the main hammer 60A relatively rotates with respect to the spindle 6. At this time, the sub hammer 60B integrally rotates with the main hammer 60A and the weight ring 75 via the coupling pins 70, 70•• while allowing the retreat of the main hammer 60A.

Then, when the stops 61 and 61 of the main hammer 60A disengage from the arms, the main hammer 60A moves forward while rotating by the balls 63 and 63 rolling toward the distal ends of the V-shaped grooves 62 and 62 by the biasing of the coil spring 64. Accordingly, the stops 61 and 61 of the main hammer 60A engage with the arms again to generate the hammering force (impact) in the rotation direction. Repeating this engagement/disengagement with/from the anvil 9 performs further fastening.

At this time, the sub hammer 60B and the weight ring 75 also rotate following the main hammer 60A, and therefore, the engagement/disengagement with/from the anvil 9 is performed with a sum of masses of both hammers 60A and 60B and the weight ring 75. In the rotation, the balls 67, 67·· on the rear surface roll on a front surface of the washer 65, and thus, a rotational resistance is reduced. Therefore, the sub hammer 60B can smoothly rotate even though the coil spring 64 extends and contracts in association with the forward and rearward movement of the main hammer 60A. Furthermore, even though the main hammer 60A repeats the forward and rearward movement when an impact occurs, the sub hammer 60B maintains to be in the rear position and does not move forward and rearward, thereby ensuring a reduced vibration when the impact occurs.

Further, the rotational speed of the motor 4 is switchable in four stages by operating a button disposed on an operation panel (not illustrated) disposed in the controller and exposed on a top surface of the battery mounting portion 18. A display disposed on the operation panel has letters of "low," "medium," "high," and "highest," and the rotational speed of the selected stage is illuminated and displayed.

Here, when a high rotational speed is selected, an inertia force by the hammer 60 increases. Therefore, this impact driver 1 ensures both electrically changing and mechanically changing the inertia force by the hammer 60.

(2) Impact Mode

Figure 8A:
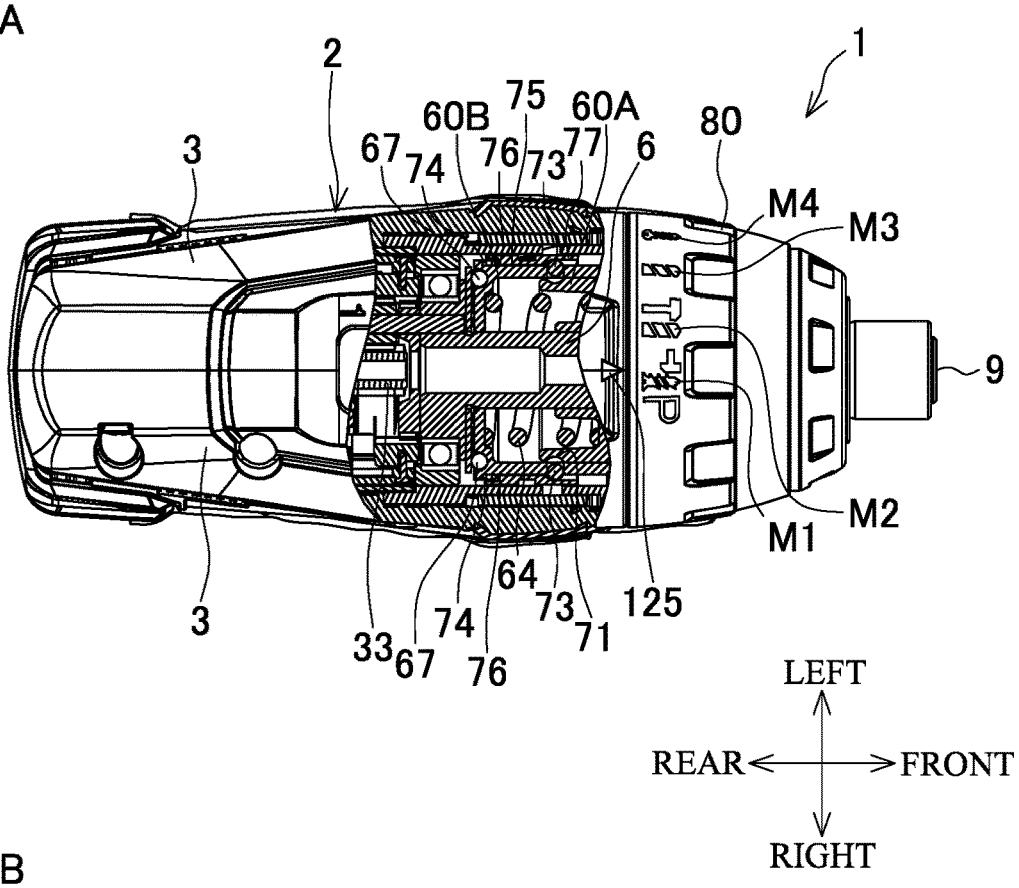
FIG. 8A is a plan view cross-sectionally illustrating a part of a unit portion in an impact mode.
Figure 8B:
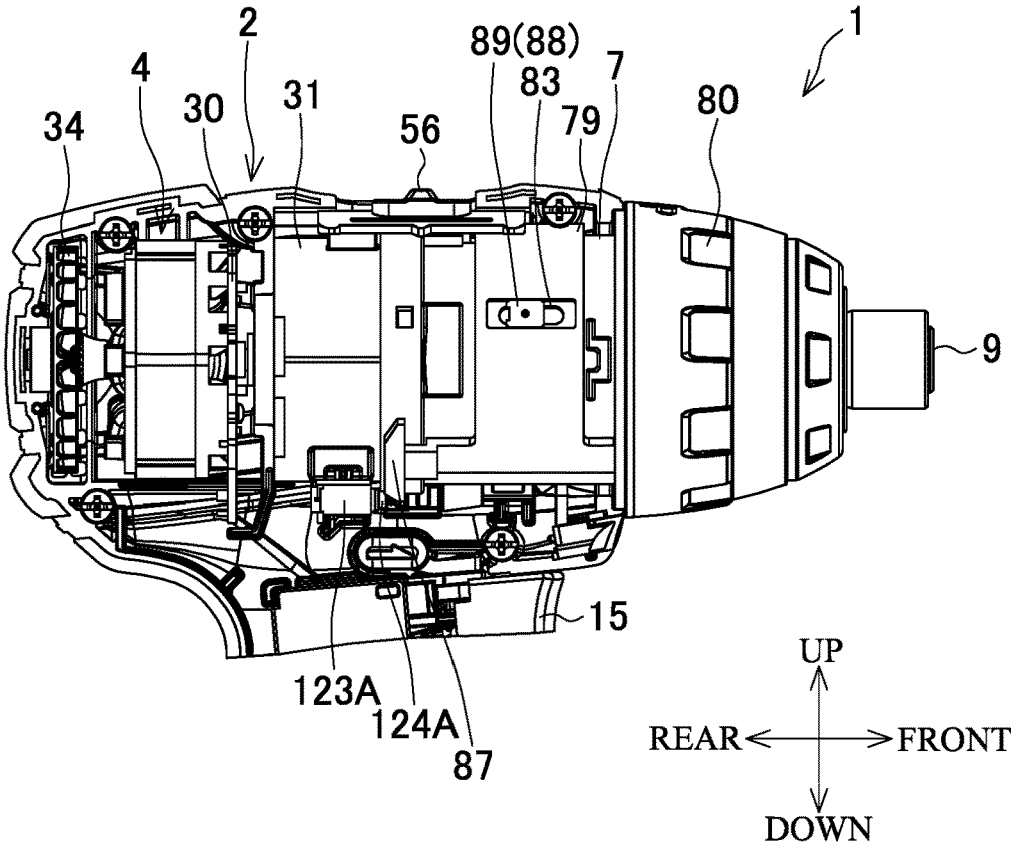
FIG. 8B is a side view omitting the right half housing.

Next, as illustrated in FIG. 8A, in a second position (switching position where an indication M1 of the mode switching ring 80 is positioned ahead of the arrow 125) provided by rotating the mode switching ring 80 to the left by a predetermined angle from the first position, the guide holder 88 also moves in a left rotational direction to move inside the guide groove 90 to reach the middle groove 92 from the inclined groove 94. Accordingly, as illustrated in FIG. 8B, the guide holder 88 is positioned at an approximately middle of the through-hole 83. Then, the weight ring 75 coupled to the guide holder 88 via the guide pin 95 moves forward to the non-linkage position where the front protrusion 76 moves away from the rear protrusion 74 of the sub hammer 60B. However, the state where the clearance groove 77 is positioned outside the balls 73 is not changed. Therefore, the balls 73 sink into the inner peripheral surface of the sub hammer 60B and can move to the release position separating from the fitting groove 71 of the main hammer 60A. Accordingly, the retreat of the main hammer 60A is allowed and an impact mode (first hammering mode, first rotation mode) that integrally rotates only the sub hammer 60B with the main hammer 60A is provided.

Also at this time, the first projection 85 of the linkage sleeve 79 is positioned in the rear of the receiving protrusion 122 of the slide button 56, and thus, the slide button 56 is moved to the advanced position. Therefore, the retreat of the slide button 56 is restricted, and the high speed mode is constantly provided. Meanwhile, the linkage plates 119 and 119 are in the retreated position so as to retreat the vibration switching ring 115 and cause the rotation of the second cam 108 to be free. The contact maker 87 is not in contact with any of the plungers 124A and 124B of the micro switches 123A and 123B.

Accordingly, operating the trigger 15 disposed in the handlebar 13 to drive the motor 4 transmits the rotation of the rotation shaft 26 to the spindle 6 via the planetary gear reduction mechanism 5, and then the spindle 6 is rotated. The spindle 6 rotates the main hammer 60A via the balls 63 and 63 to rotate the anvil 9 with which the main hammer 60A engages. Therefore, the bit mounted on the distal end of the anvil 9 can, for example, tighten a screw. At this time, the sub hammer 60B coupled to the main hammer 60A in the rotation direction via the coupling pins 70 also rotates integrally with the main hammer 60A, but the weight ring 75 in the non-linkage position does not integrally rotate. It should be noted that, even though the first cam 104 rotates in association with the rotation of the anvil 9, the rotation of the second cam 108 that engages with the first cam 104 is free. Therefore, the second cam 108 also integrally rotates, and thus, no vibration is generated in the anvil 9.

As the screw is tighten and the torque of the anvil 9 increases, a difference is generated between the rotation of the main hammer 60A and the rotation of the spindle 6. Therefore, the balls 63 and 63 rolling along the V-shaped grooves 62 and 62 causes the main hammer 60A to retreat against the biasing of the coil spring 64 while the main hammer 60A relatively rotates with respect to the spindle 6. At this time, the sub hammer 60B integrally rotates with the main hammer 60A via the coupling pins 70 while allowing the retreat of the main hammer 60A.

Then, when the stops 61 of the main hammer 60A disengage from the arms, the main hammer 60A moves forward while rotating by the balls 63 rolling toward the distal ends of the V-shaped grooves 62 by the biasing of the coil spring 64. Accordingly, the stops 61 of the main hammer 60A engage with the arms again to generate the hammering force (impact). Repeating this engagement/disengagement with/from the anvil 9 performs further fastening.

At this time, the sub hammer 60B also rotates following the main hammer 60A, and therefore, the engagement/disengagement with/from the anvil 9 is performed with a sum of masses of both hammers 60A and 60B. In the rotation, the balls 67 on the rear surface of the sub hammer 60B roll on the front surface of the washer 65, and thus, the rotational resistance is reduced. Therefore, the sub hammer 60B can smoothly rotate even though the coil spring 64 extends and contracts in association with the forward and rearward movement of the main hammer 60A. Furthermore, even though the main hammer 60A repeats the forward and rearward movement when the impact occurs, the sub hammer 60B maintains to be in the rear position and does not move forward and rearward, thereby ensuring the reduced vibration when the impact occurs.

(3) Vibration Drill Mode

Next, in a third position (switching position where an indication M2 of the mode switching ring 80 is positioned ahead of the arrow 125) provided by rotating the mode switching ring 80 to the left by a predetermined angle from the second position, the guide holder 88 also moves in the left rotational direction in the circumferential direction to move inside the guide groove 90 to reach the front side groove 91. Accordingly, the guide holder 88 is positioned at a front end of the through-holes 83 similarly to the case of the drill mode illustrated in FIG. 9B. Then, the weight ring 75 moves forward, and thus, the balls 73 are pushed to the axial center side in the rear of the clearance groove 77 so as to be fitted to the fitting groove 71 of the main hammer 60A. Accordingly, the balls 73 are secured in a coupling position similarly to the case of the drill mode illustrated in FIG. 9A. Therefore, the main hammer 60A and the sub hammer 60B are coupled in the front-rear direction, and the retreat of the main hammer 60A is restricted.

At this time, the linkage plates 119 and 119 move forward by guiding of the engagement protrusion 121 along the guide groove of the mode switching ring 80. Accordingly, the vibration switching ring 115 moves to the advanced position, and thus, the vibration drill mode that restricts the rotation of the second cam 108 is provided.

Meanwhile, the first projection 85 of the linkage sleeve 79 is still positioned in the rear of the receiving protrusion 122 similarly to the case of the impact mode. Therefore, the retreat of the slide button 56 is restricted, and the high speed mode is constantly provided. The contact maker 87 only pushes the plunger 124A of the micro switch 123A, and therefore, clutch is not actuated.

Accordingly, operating the trigger 15 to rotate the spindle 6 causes the spindle 6 to rotate the main hammer 60A via the balls 63 and 63, thus the anvil 9 with which the main hammer 60A engages is rotated. When the first cam 104 rotates in association with the rotation of the anvil 9, the first cam 104 interferes with the second cam 108, whose rotation is restricted, on the cam surfaces 105 and 109. Since the anvil 9 is pivotally supported with a play in the front and rear of the arms, the interference between the cam surfaces 105 and 109 generates a vibration in the axial direction in the anvil 9. The sub hammer 60B, which is coupled to the main hammer 60A in the rotation direction via the coupling pins 70, also rotates integrally with the main hammer 60A.

Then, even when the torque of the anvil 9 increases, the main hammer 60A is restricted from retreating by the balls 73, and thus, the engagement/disengagement operations of the main hammer 60A with/from the anvil 9 is not performed. Accordingly, no impact is generated, and the anvil 9 rotates integrally with the spindle 6.

(4) Drill Mode

Figure 9A:
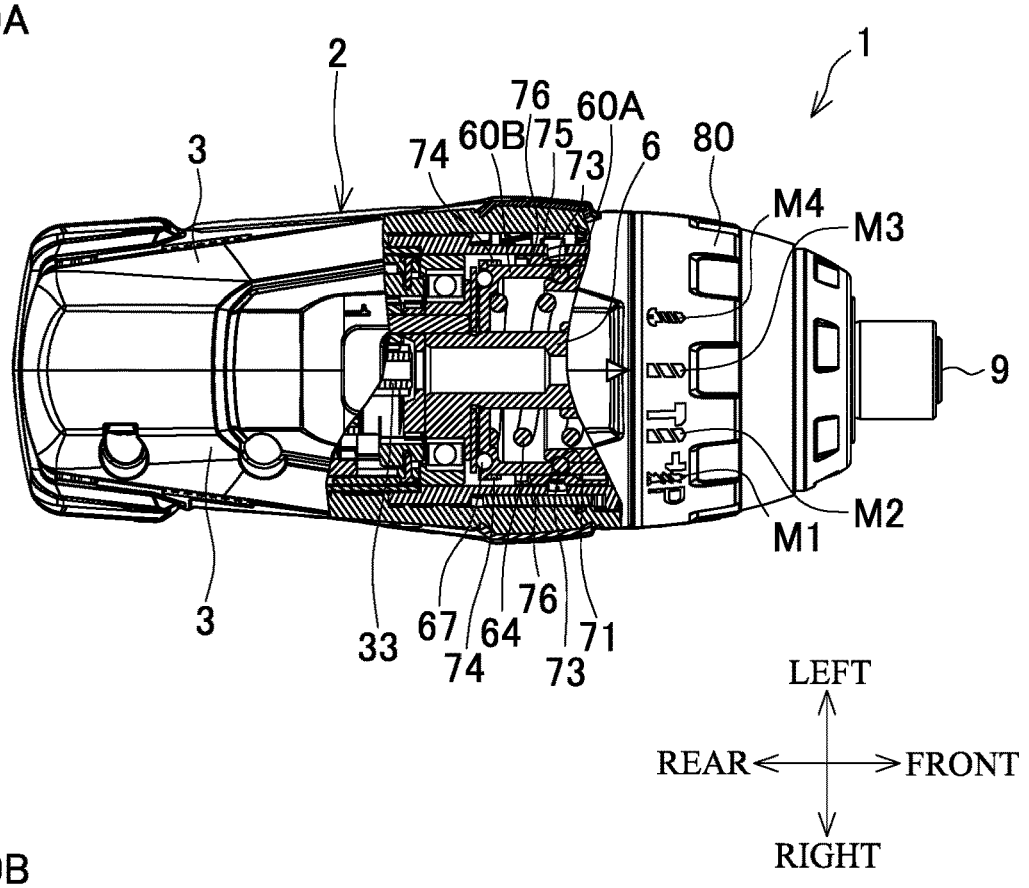
FIG. 9A is a plan view cross-sectionally illustrating a part of a unit portion in a drill mode.
Figure 9B:
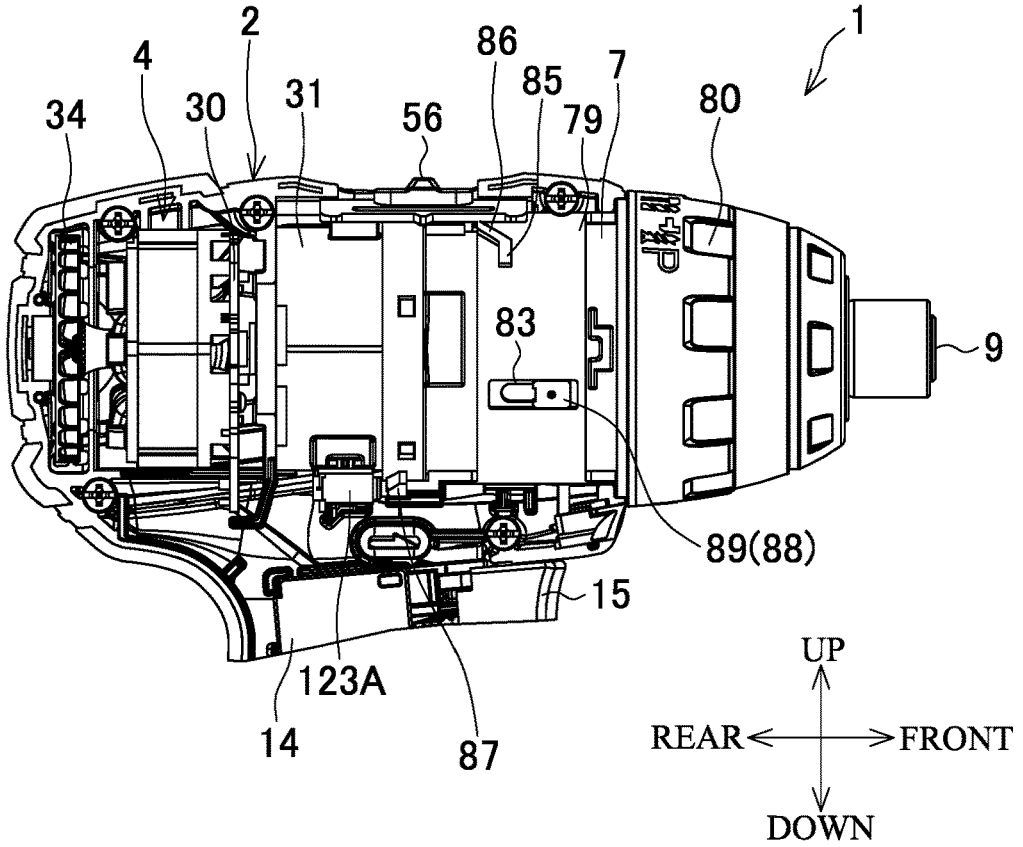
FIG. 9B is a side view omitting the right half housing.

Next, as illustrated in FIGS. 9A and 9B, in a fourth position (switching position where an indication M3 of the mode switching ring 80 is positioned ahead of the arrow 125) provided by rotating the mode switching ring 80 to the left by a predetermined angle from the third position, the guide holder 88 also moves in the left rotational direction in the circumferential direction. However, the guide holder 88 is positioned within the front side groove 91 in this state, and therefore, a state where the guide holder 88 is positioned at the front end of the through-hole 83 does not change. Thus, the weight ring 75 is in the advanced position, and the balls 73 are also secured to the coupling position where the balls 73 fit in the fitting groove 71 of the main hammer 60A. Accordingly, the main hammer 60A and the sub hammer 60B are coupled in the front-rear direction, thereby providing a drill mode that restricts the retreat of the main hammer 60A.

At this time, the linkage plates 119 and 119 retreat by the guiding of the engagement protrusions 121 along the guide grooves of the mode switching ring 80 to retreat the vibration switching ring 115 so as to cause the rotation of the second cam 108 to be free. The contact maker 87 simultaneously pushes the plungers 124A and 124B of both micro switches 123A and 123B, and therefore, clutch is not actuated.

Meanwhile, the first projection 85 of the linkage sleeve 79 moves away from the slide button 56 to the left side, and the second projection 86 has the end portion positioned in a rear with respect to the receiving protrusion 122, thereby ensuring the retreat of the slide button 56. Thus, any of high and low modes is selectable.

Accordingly, operating the trigger 15 to rotate the spindle 6 causes the spindle 6 to rotate the main hammer 60A via the balls 63, thus the anvil 9 with which the main hammer 60A engages is rotated. At this time, the sub hammer 60B, which is coupled to the main hammer 60A in the rotation direction via the coupling pins 70, also rotates integrally with the main hammer 60A, but the weight ring 75 in the non-linkage position does not rotate integrally with the sub hammer 60B. It should be noted that, even though the first cam 104 rotates in association with the rotation of the anvil 9, the rotation of the second cam 108 that opposes the first cam 104 is free, and thus, no vibration is generated in the anvil 9.

Then, even when the torque of the anvil 9 increases, the main hammer 60A is restricted from retreating by the balls 73, and thus, the engagement/disengagement operation of the main hammer 60A with/from the anvil 9 is not performed. Accordingly, no impact is generated, and the anvil 9 rotates integrally with the spindle 6.

(5) Clutch Mode

Next, in a fifth position (switching position where an indication M4 of the mode switching ring 80 is positioned ahead of the arrow 125) provided by rotating the mode switching ring 80 to the left by a predetermined angle from the fourth position, the guide holder 88 also moves in the left rotational direction in the circumferential direction, but is positioned within the front side groove 91 in this state, and therefore, a state where the guide holder 88 is positioned in the front end of the through-hole 83 does not change. Accordingly, the weight ring 75 is in the advanced position, and the balls 73 are also secured to the coupling position where the balls 73 are fitted in the fitting groove 71 of the main hammer 60A. The main hammer 60A and the sub hammer 60B are coupled in the front-rear direction, thereby restricting the retreat of the main hammer 60A.

At this time, the linkage plates 119 and 119 are in the retreated position to retreat the vibration switching ring 115 so as to cause the rotation of the second cam 108 to be free. However, the contact maker 87 only pushes the plunger 124B of the micro switch 123B, and therefore, a clutch mode is provided.

Meanwhile, since the first and second projections 85 and 86 are away from the slide button 56 to the left side, any of forward and rearward slide operations of the slide button 56 is possible.

Accordingly, operating the trigger 15 to rotate the spindle 6 causes the spindle 6 to rotate the main hammer 60A via the balls 63, thus the anvil 9 with which the main hammer 60A engages is rotated. At this time, the sub hammer 60B, which is coupled to the main hammer 60A in the rotation direction via the coupling pins 70, also rotates integrally with the main hammer 60A, but the weight ring 75 in the non-linkage position does not rotate integrally with the sub hammer 60B. It should be noted that, even though the first cam 104 rotates in association with the rotation of the anvil 9, the rotation of the second cam 108 that opposes the first cam 104 is free, and thus, no vibration is generated in the anvil 9.

Then, when the torque of the anvil 9 increases and a torque value detected by the torque sensor reaches the set torque value, the controller brakes the motor 4, and thus, the torque transmission from the spindle 6 to the anvil 9 is cut off.

It should be noted that when the drill mode or the clutch mode used in a low speed is switched to the vibration drill mode, the impact mode, or the power impact mode, an operation being converse to the above-described operation is performed. The second projection 86 away from the slide button 56 engages with the receiving protrusion 122 of the slide button 56 in the retreated position by a right rotation of the linkage sleeve 79. Then, the slide button 56 is moved to the advanced position while the receiving protrusion 122 is relatively slid along the second projection 86 in association with the rotation of the linkage sleeve 79 in this state. Accordingly, the high speed mode is always provided in the vibration drill mode, the impact mode, and the power impact mode.

Thus, the impact driver 1 having the above-described configuration includes the motor 4, the first hammer (hammer 60), the anvil 9, and the second hammer (weight ring 75). The first hammer is rotated by the driving of the motor 4. The anvil 9 is hammered in the rotation direction by the first hammer. The second hammer is configured to be switchable between a state being linked and a state not being linked to the first hammer. The impact driver 1 ensures selections of the first hammering mode (impact mode) in which only the first hammer (hammer 60) hammers the anvil 9 and the second hammering mode (power impact mode) in which the first hammer (hammer 60) and the second hammer (weight ring 75) hammer the anvil 9. Therefore, the hammering force and the inertia force are easily switchable.

Here in particular, the hammer 60 includes the main hammer 60A and the sub hammer 60B. The main hammer 60A hammers the anvil 9 by moving forward and rearward in the axial direction of the anvil 9 to engage/disengage with/from the anvil 9. The sub hammer 60B is restricted from moving forward and rearward in the axial direction and is integrally linked to the main hammer 60A in the rotation direction. The second hammer (weight ring 75) is configured to be switchable between a state being linked and a state not being linked to the sub hammer 60B. Therefore, using the sub hammer 60B, which does not move forward and rearward, ensures easily switching the hammering force and the inertia force.

The impact driver 1 further includes linking means (fitting groove 71, circular hole 72, and ball 73) configured to integrally link the main hammer 60A and the sub hammer 60B in the front-rear direction. The linkage between the main hammer 60A and the sub hammer 60B by the linking means ensures a selection of the drill mode that restricts the front-rear movement of the main hammer 60A to cause the main hammer 60A to rotate integrally with the anvil 9.

Therefore, the number of the selectable operation mode increases, thereby further improving usability.

The impact driver 1 having the above-described configuration includes the motor 4, the spindle 6, the hammer 60, the anvil 9, an inertia force increasing member (weight ring 75), the housing (main body housing 2), and a mode switching member (mode switching ring 80). The spindle 6 is rotated by the driving of the motor 4. The hammer 60 is retained by the spindle 6. The anvil 9 is hammered in the rotation direction by the hammer 60. The inertia force increasing member increases the inertia force in the hammering by the hammer 60. The housing (main body housing 2) houses the motor 4, the spindle 6, the hammer 60, and the anvil 9. The mode switching member (mode switching ring 80) is disposed in the housing (main body housing 2). Operating the mode switching member (mode switching ring 80) ensures the selections of the first position (position of impact mode), the second position (position of power impact mode), and the third position (position of drill mode). In the first position, the hammer 60 hammers the anvil 9. In the second position, the hammer 60 whose inertia force is increased by the inertia force increasing member (weight ring 75) hammers the anvil 9. In the third position, the spindle 6, the hammer 60, and the anvil 9 integrally rotate. Therefore, the hammering force and the inertia force are easily switchable and three operation modes are selectable in one tool, thereby improving the usability.

Here in particular, the rotational speed of the motor 4 is switchable between a plurality of stages (four stages, here), thereby ensuring setting the hammering force and the inertia force more specifically.

Furthermore, the impact driver 1 having the above-described configuration includes the motor 4 and the hammer 60. The hammer 60 is rotated by the driving of the motor 4. Changing the mass of the hammer 60 by the linkage/non-linkage to the weight ring 75 ensures changing the inertia force by the rotation of the hammer 60, and changing the rotational speed of the motor 4 ensures changing the inertia force. Therefore, both electrically changing and mechanically changing the inertia force by the hammer 60 are possible, thereby ensuring setting the inertia force more specifically.

The impact driver 1 having the above-described configuration includes the motor 4, a first rotating member (hammer 60), the output shaft (anvil 9), and a second rotating member (weight ring 75). The first rotating member is rotated by the driving of the motor 4. The output shaft (anvil 9) is rotated by the rotation of the first rotating member (hammer 60). The second rotating member (weight ring 75) is configured to be switchable between a state being linked and a state not being linked to the first rotating member (hammer 60). The impact driver 1 ensures selections of the first rotation mode (impact mode) in which only the first rotating member (hammer 60) rotates the output shaft (anvil 9) and the second rotation mode (power impact mode) in which the first rotating member (hammer 60) and the second rotating member (weight ring 75) rotate the output shaft (anvil 9). Therefore, the inertia force is easily switchable.

Further, the engagement/disengagement structure between the main hammer and the sub hammer is not limited by the rear protrusion and the front protrusion in the above-described configuration. For example, the front protrusion may be formed at the rear end, not in the inner peripheral side of the weight ring, and a count and a shape of the protrusion may be changed.

In the above-described configuration, while the weight ring is configured to be linked/non-linked to the sub hammer, the weight ring may be configured to be linked/non-linked to the main hammer. Accordingly, the hammer is not limited to the structure divided into the main hammer and the sub hammer. The inertia force increasing member can be added to the impact tool that includes only one hammer.

Furthermore, means for reducing friction may be provided between the inner housing and the sub hammer and/or between the inner housing and the weight ring. As this friction reduction means, it is possible to, for example, interpose a bearing (such as metal and needle bearings) between the two, interpose a low friction material between the two, and coat a low friction material on an inner surface of the inner housing and/or an outer surface of the sub hammer, and/or an inner surface of the inner housing and/or an outer surface of the weight ring.

In the above-described configuration, including a vibration mechanism, a micro switch, and the like ensures additional selections of the vibration drill mode, the drill mode, and the clutch mode, in addition to the power impact mode and the impact mode. On the other hand, the vibration mechanism, the micro switch, and the like may be eliminated to make the impact tool that ensures selections of only two operation modes of the power impact mode and the impact mode or only three operation modes of the power impact mode, the impact mode, and the drill mode. The transmission mechanism may be omitted as well.

It is explicitly stated that all features disclosed in the description and/or the claims are intended to be disclosed separately and independently from each other for the purpose of original disclosure as well as for the purpose of restricting the claimed invention independent of the composition of the features in the embodiments and/or the claims. It is explicitly stated that all value ranges or indications of groups of entities disclose every possible intermediate value or intermediate entity for the purpose of original disclosure as well as for the purpose of restricting the claimed invention, in particular as limits of value ranges.

What is claimed is:

1. An impact tool comprising:

a motor;

a spindle configured to be rotated by driving of the motor;

a hammer retained by the spindle;

an anvil configured to be hammered in a rotation direction by the hammer;

an inertia force increasing member that increases inertia force in the hammering by the hammer;

a housing that houses the motor, the spindle, the hammer, and the anvil; and a mode switching member disposed in the housing, wherein:

the impact tool is configured to have at least three modes of operation, a first mode in which the hammer hammers the anvil, a second mode in which the hammer whose inertia force is increased by the inertia force increasing member hammers the anvil, and a third mode in which the spindle, the hammer, and the anvil integrally rotate; and the mode switching member is operable to alternatively place the impact tool in the at least three modes of operation.

2. The impact tool according to claim 1, wherein the inertia force increasing member is a weight ring externally mounted on the hammer, the inertia force increasing member being in a non-linkage to the hammer in the first position, the inertia force increasing member being linked to the hammer in the second position.

* * * * *